United States Patent [19]

Takada et al.

[11] Patent Number: 4,875,069

[45] Date of Patent: Oct. 17, 1989

[54] ANTI-FOULING DEVICE FOR SHEET GRIPPER

[75] Inventors: Yusaku Takada, Tokyo; Kenji Takeda, Yokohama, both of Japan

[73] Assignee: Canon Kabushiki Kaisha, Tokyo, Japan

[21] Appl. No.: 271,364

[22] Filed: Nov. 14, 1988

Related U.S. Application Data

[63] Continuation of Ser. No. 145,595, Jan. 19, 1988, abandoned.

[30] Foreign Application Priority Data

Jan. 19, 1987 [JP] Japan ..... 62-008308
Jan. 19, 1987 [JP] Japan ..... 62-004950[U]

[51] Int. Cl.[4] ..... G03G 15/00

[52] U.S. Cl. ..... 355/271; 355/326; 271/82; 271/277; 101/408

[58] Field of Search ..... 355/3 TR, 4, 3 DR, 3 SH, 355/14 TR; 271/277, 204, 206, 82; 101/408, 409, 411

[56] References Cited

U.S. PATENT DOCUMENTS 3,612,677 10/1971 Langdon et al. ..... 355/4
3,620,616 11/1971 Davidson et al. ..... 355/3 TR
3,702,482 11/1972 Dolcimascolo ..... 355/3 TR
3,827,803 8/1974 Shelffo et al. ..... 271/297
3,903,795 9/1975 Suzuki ..... 101/409
4,431,303 2/1984 Hoffman ..... 355/3 TR
4,605,298 8/1986 Russel et al. ..... 355/3 TR
4,607,935 8/1986 Kindt et al. ..... 355/3 TR
4,699,368 10/1987 Hiraoka et al. ..... 271/277

*Primary Examiner*—R. L. Moses
*Attorney, Agent, or Firm*—Fitzpatrick, Cella, Harper & Scinto

[57] ABSTRACT

A transfer device for transferring a toner image onto a transfer material includes transfer material supporting device having a sheet-like material for supporting the transfer material and a supporting member for supporting the sheet-like material for movement along an endless path, gripper, mounted in an opening in the supporting member for releasably gripping an end of the transfer material, a sheet member mounted on the gripper to cover at least a portion of the gripper. A transfer device for transferring a toner image onto a transfer material includes a transfer drum including a transfer material supporting drum including a cut-away portion and a longitudinal strip, the cut-away portion being covered with a sheet-like member for supporting the transfer material, and wherein an end portion of the sheet-like material is bent toward inside of the transfer material supporting drum, and further including a releasable gripper disposed in the supporting drum for releasably gripping an end of the transfer material; and a cleaner contactable to the transfer drum to clean the same.

23 Claims, 4 Drawing Sheets

ANTI-FOULING DEVICE FOR SHEET GRIPPER

This application is a continuation of application Ser. No. 145,595 filed January 19, 1988, now abandoned.

FIELD OF THE INVENTION AND RELATED ART

The present invention relates to an anti-fouling device for a transfer material gripper, whereby the gripper is prevented from being contaminated with toner in an apparatus for transferring a toner image onto a transfer material.

When images formed sequentially by different color toners on an electrophotographic sensitive member as in a color copying machine of an electrophotographic type, are transferred in superimposed relation onto a sheet-like transfer material such as a sheet of paper, it is required, in order to prevent misregistration of color component images, that the transfer material be rigidly retained at a predetermined position of a supporting member.

In order to achieve this, it has been proposed that a gripper or grippers be provided on a transfer drum (transfer material supporting member) in the form of a cylinder rotatable in synchronism with a photosensitive member rotating in an endless path, the gripper gripping a leading edge of a transfer material to assure the position of the transfer material during the transfer operations.

FIG. 1 is a perspective view of the transfer drum with a photosensitive member in an electrophotographic color copying machine using the above gripper. The transfer drum 1 extends parallel and in close proximity with a cylindrical photosensitive member 2 shown by chain lines, in synchronism with which the transfer drum 1 rotates.

The transfer drum 1 includes ring portions 1*a* and 1*b* at longitudinal ends and a connecting portion 1*c* in the form of a strip. A sheet 4 of dielectric material in the form of a mesh of resin fiber or a sheet 4 of a resin film is stretched around the periphery of the transfer drum.

The connecting portion 1*c* is provided with plural grippers 3 (gripping means) disposed to correspond to sizes of transfer materials to be processed. The transfer drum rotates in the direction of an arrow by an unshown driving source, and when the grippers 3 come to a predetermined position, the transfer material supplied along the transfer material guide 5 is gripped by the gripper. The gripped transfer material is supplied to the transfer station close to the photosensitive member, where an image or images are transferred onto the same transfer material. After the image transfer, the transfer material is separated from the drum 1 and is transported for the next processing.

A cleaning device 6 is provided which is contacted to the dielectric sheet 4 only when no transfer material is supported on the transfer drum, to remove toner remaining thereon. For this purpose, the cleaning device 6 is provided with a rotary brush.

Around the photosensitive drum 2, there are provided a primary charger, image signal applying means, a developing device and a cleaning device which are effective in combination to perform an image forming operation. Around the transfer drum 1, there are provided a transfer charger, a cam for closing and opening the gripper and separating means for separating the transfer material from the transfer drum.

The gripper described above includes a plate member which is rotationally movable between open and close positions on the connecting portion of the transfer drum. The gripper is normally biased toward its closing position by a spring or the like. Only when the transfer material is to be received or separated out, the gripper is opened by the cam or the like. The dielectric sheet 4 is extended so as to circumvent the gripper.

Therefore, the circumferential ends of the sheet 4 are adjacent the grippers. This fact, together with existence of the grippers, necessarily results in the presence of a number of small projected or recessed portions.

Therefore, even if the cleaning brush cleans the transfer material supporting member, the portions adjacent the grippers are not sufficiently cleaned. Thus, the toner T stagnates in those portions, with the result that the subsequent transfer materials are contaminated by the toner T remaining in the neighborhood of the grippers. Particularly when a transfer material which is larger than the previous transfer material is used, the backside of the current transfer material is contaminated by the toner remaining adjacent the grippers in the area outside the previous transfer material.

Another problem is that as the cleaning brush rubs the gripper portions many times, a circumferential end of the dielectric sheet 4 tends to be peeled, with the result that the tranfer material can not be properly gripped, or that the toner is stagnated in the peeled portion, which also contaminate the backside of the transfer material, which are all inconvenient.

FIG. 2, is a partial sectional view of the gripper without the transfer material gripped thereby. As shown in this figure, there is provided a friction member 3*b* of rubber material or the like to assure that the leading edge of the transfer material is gripped with certainty.

SUMMARY OF THE INVENTION

Accordingly, it is a principal object of the present invention to prevent contamination of a transfer device by toner.

It is another object of the present invention to prevent a device for supporting the transfer material upon image transfer from being contaminated by toner.

It is a further object of the present invention to prevent a device for supporting a transfer material upon an image transfer operation from being contaminated by a cleaning device.

It is a further object of the present invention to prevent projected and recessed portions adjacent a gripper for gripping a leading edge of the transfer material from being contaminated by toner.

According to an embodiment of the present invention, a cover member is provided to cover the gripper at least at the side adjacent the leading edge of the transfer material.

According to another embodiment of the present invention, a circumferential end or ends of the sheet material of the transfer material supporting member are bent into the supporting member toward the inside thereof. The gripper is movable between a gripping position and a releasing position, selectively. The sheet for supporting the transfer material may be in the form of a film, a mesh or a sheet having fine openings.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
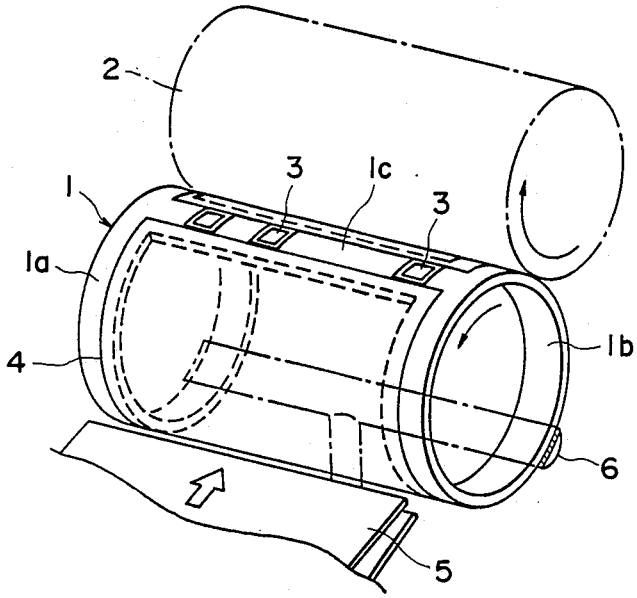
FIG. 1 is a perspective view of an image transfer device to which the present invention is applicable.
Figure 2:
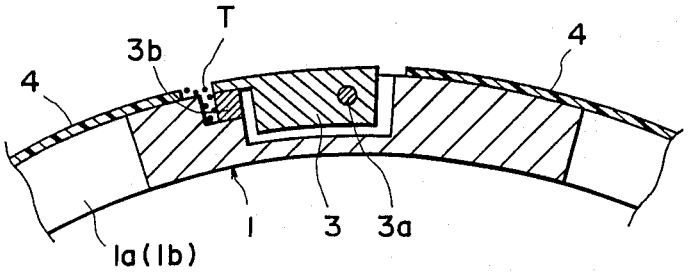
FIG. 2 is a sectional view of a gripper for a transfer drum.
Figure 3:
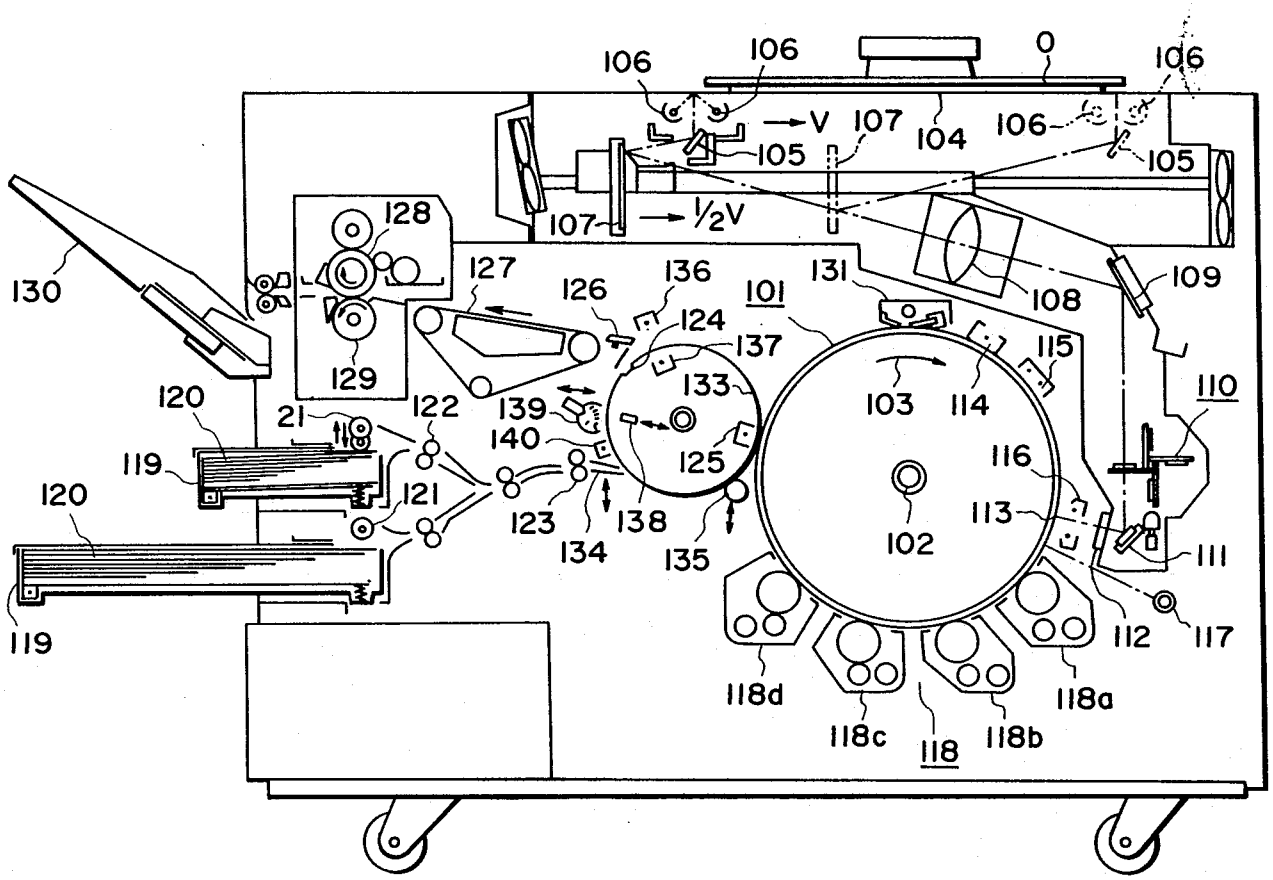
FIG. 3 is a sectional view of a color electrophotographic copying apparatus to which the present invention is applicable.

Referring now to FIG. 3, there is shown an electrophotographic color copying machine of an image transfer type as an exemplary machine to which the present invention is applicable. In this embodiment, a means for supporting the transfer material includes a dielectric sheet. But a dielectric material screen or sheet can be usable in place thereof.

The apparatus comprises an electrophotographic photosensitive drum 101 including a surface insulating layer, a photoconductive layer and a conductive layer. The drum 101 is rotationally supported on a shaft 102. Upon copy instruction, it starts to rotate in the direction indicated by an arrow 103. When the drum 101 rotates to a predetermined rotational position, an original on placed on the original supporting plate glass 104 is illuminated by an illumination lamp 106 which is integral with a first scanning mirror 105, and the light reflected by the original is directed to the second scanning mirror 107. A light image formed by the reflected light is color-separated by a color separation filter 110 after it is passed through a lens 108 and reflected by a third mirror 109. Further, the light is directed through a fourth mirror 111 and a sealing glass 112 for protection from dust, and finally the light is imaged on the drum 101 at an image exposure station 110.

Then, the drum 101 is discharged by a discharger 114, and subsequently is charged by a primary charger 115 and thereafter, it is exposed through a slit at the exposure station 113 to the light image provided by the illumination lamp 106. Simultaneously therewith, a discharger 116 which is an AC discharger or a DC discharger of a polarity opposite to the primary charger, discharges the photosensitive member. Subsequently, the photosensitive drum is exposed to uniform light by a whole surface exposure lamp 117. As a result, an electrostatic latent image is formed on the drum 101.

The electrostatic latent image thus formed on the photosensitive drum 101 is developed into a toner image by a developing device 118. The developing device 118 includes four developing means, i.e., a yellow developing means **118*a*, a magenta developing means 118*b*, a cyan developing means 118*c* and a black developing means 118*d***. In response to the selection of the color separation filters used upon the image exposure, one of the developing means is selected to provide a toner image in a proper color.

A transfer material 120 which is a sheet of plain paper is fed out of a cassette 119 by a pick-up roller 121. The transfer sheet is generally timed by a first registration roller 122, and then in correctly timed by a second registration roller 123, and then, the leading edge thereof is gripped by a gripper 124 of the transfer drum 133. With rotation of the transfer drum 133, the transfer sheet is conveyed while being wrapped on the sheet stretched over the transfer drum. While the transfer material 120 is passed between the transfer charger 125 and the photosensitive drum 101 on the transfer drum, it receives the toner image from the photosensitive drum 101; and simultaneoulsy, the transfer material 120 is retained on the sheet by electrostatic force.

In the first image transfer operation, the transfer material 120 is electrostatically attracted on the sheet of the transfer material supporting member only in the area downstream of the transfer charger 125. In the upstream side, the retaining force is so small that the transfer material 120 is dragged by the photosensitive drum 101 with the result of misregistration. To avoid this, a confining roller 135 is used. The confining roller 135 and the sheet feeding guide 134 are moved away from the transfer drum 135 after the transfer sheet is passed for the first time. The transfer drum 133 grips the leading edge of the transfer material 120 by the gripper 124 and electrostatically retain the transfer material 120, while rotating a required number of times to receive the required number of images.

After completion of the image transfer, the transfer material is released from the gripper 124 and is separated by a separating pawl 126 with the aid of separation dischargers 136 and 137 and is guided to a conveyor belt 127. Then, the transfer material 120 is introduced into a nip formed between image fixing rollers 128 and 129, by which the toner image is pressed and heated to be fixed into a permanent image. Thereafter, the transfer material 120 is discharged onto a discharge tray 130. After the image transfer, the surface of the photosensitive drum 101 is cleaned by a cleaning device 131 comprising an elastic blade to be prepared for the next cycle.

On the other hand, the dielectric sheet of the transfer drum 133 is cleaned at both sides by a cleaning blade 138 and a fur brush 139 which are contacted to the dielectric sheet only upon the cleaning operation. As required, an overcharge preventing discharger 140 operates to remove the excessive charge, to be prepared for the next image forming cycle.

Now, an embodiment of the present invention will be described wherein it is applied to the above described color electrophotographic copying machine.

Figure 4:
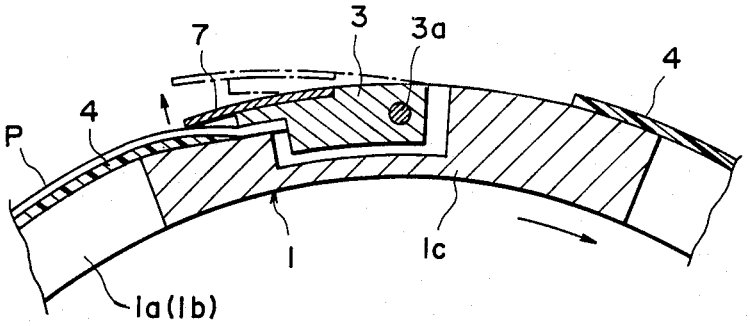
FIG. 4 is a sectional view of a gripper according to an embodiment of the present invention.

Referring to FIG. 4, there is shown a structure around the gripper 124 of a transfer drum 133 shown in FIG. 3. In this FIG., the gripper 124 grips the leading edge of the transfer material P.

A gripper 3 is rotatably supported by a pin **3*a* extending parallel to the axis of the transfer drum 1 and is normally urged to the shown closed position by an unshown spring. When the gripper comes to a position for receiving the transfer sheet P, the left end of the gripper 3 as viewed in FIG. 4 is moved upwardly by an unshown cam or the like to open the gripper (shown by chain lines). After the transfer material P is received by this, the gripper 3** is closed to catch the transfer material. With rotation of the transfer drum, the transfer material is conveyed to an unshown transfer station.

Around the periphery of the transfer drum 1, a dielectric sheet 4 is stretched, and the circumferential ends thereof are disposed adjacent the gripper.

A cover member 7 having a proper flexibility or elasticity is mounted to the outer surface of the gripper 3 to cover the free end of the gripper 3 and a circumferential end portion of the dielectric sheet 4. As for the material of the cover member 7, polyester film, polyethyleneterephthalate film or the like which is flexible is usable. The thickness thereof is preferably approximately 50 microns to sufficiently follow movement of the gripper 3. The thickness of the cover member is as small as possible in terms of the distance from the photosensitive member, provided that the covering function is not deteriorated by deformation. In this manner, the free end portion of the gripper 3 and the end portion of the dielectric sheet 4 are covered by the covering member 7, and in addition, it is generally flat, and therefore, when the cleaning brush 139 (FIG. 3) cleans, a sufficient cleaning is possible. By this, adverse affect of the remaining toner to the next transfer sheet can be effectively prevented.

Figure 5:
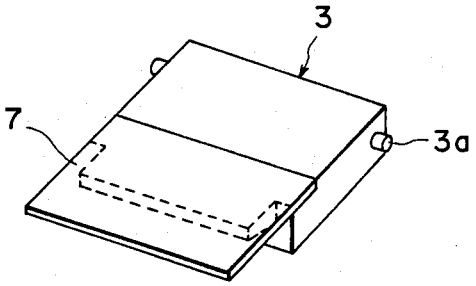
FIG. 5 is a perspective view of a gripper according to an embodiment of the present invention.

FIG. 5 is a perspective view of the gripper itself. As will be understood from this figure, the cover member has a width which is larger than that of the free end of the gripper, by which the cover member can cover the lateral portion of the recess which accommodates the gripper and which is formed in the connecting portion of the transfer material supporting drum.

In the above described structure, the gripper and the cover member are separate members. However, by suitably selecting the material so that the same material is used for the cover member and the gripper, they may be formed as a unit. In this case, the cover member may be of a metal foil.

Figure 6:
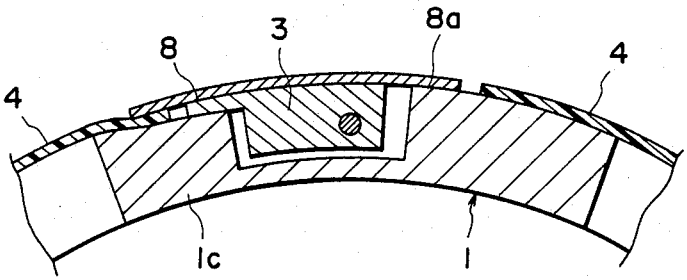
FIGS. 6 and 7 are sectional views of grippers according to further embodiments of the present invention.

Referring to FIG. 6, there is shown another embodiment, wherein an end of the cover member 8 is mounted at a position 8*a* on the connecting portion 1*c*. The other end extends beyond the free end of the gripper to cover the edge of the dielectric sheet 4.

The cover member 8 has a suitable flexibility or elasticity to be flexed following opening and closing operation of the gripper.

The cover member may be provided for each of the plural grippers 3 disposed on the connecting portion. Alternatively, one cover member may be provided for all the grippers. The latter is preferable from the standpoint of effective cleaning operation.

Figure 7:
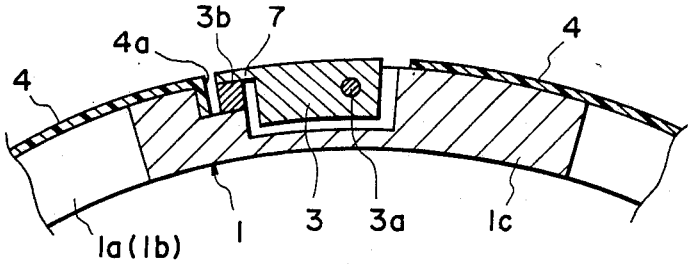

Referring to FIG. 7, a further embodiment will be described. FIG. 3 is a sectional view of a part of the gripper 124 of the transfer drum 133 of the apparatus shown in FIG. 3.

A dielectric sheet 4 is stretched around the periphery so as to constitute a cylindrical transfer drum 1. The feature of this embodiment is that a circumferential end portion 4*a* of the dielectric sheet 4 adjacent the free end 3*b* of the gripper 3 is bent toward the central axis of the cylindrical transfer drum. With this structure, even if the transfer drum 1 is rubbed by the cleaning brush, the end portion is not peeled off. Therefore, it can be avoided that the peeled sheet 4 obstructs supporting the transfer material P and that the toner is retained in the peeled portion to contaminate the transfer material.

Figure 8:
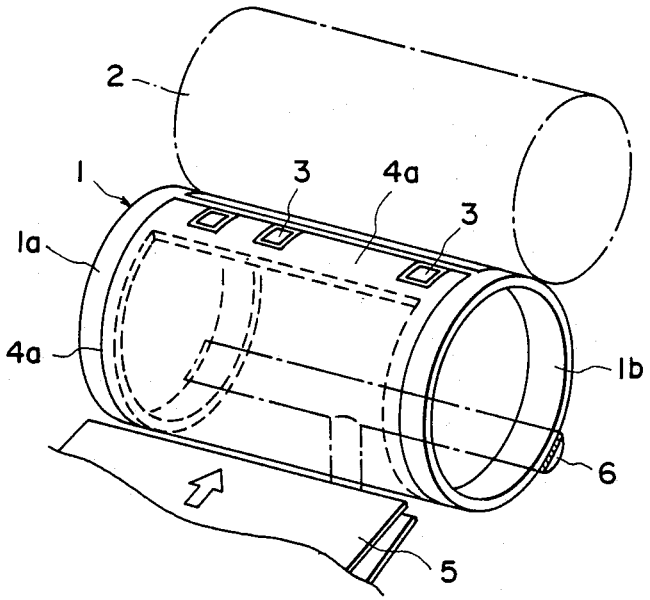
FIG. 8 is a perspective view of a gripper according to a further embodiment of the present invention.

FIG. 8 shows a modification of FIG. 7 embodiment. In the structure of FIG. 7, the bent portion is formed only at the portion corresponding to the leading edge of the gripper among the sides of the recess formed in the connecting portion 1*c*. In FIG. 8, the dielectric sheet 4*a*is stretched substantially over the entire periphery except for the portions where the grippers exist. In this arrangement, the bent portions are formed all the sides of the gripper.

In FIG. 7 embodiment, the bent portions are formed only in the gripper portions so as to prevent easy peeling of the dielectric sheet adjacent the grippers. However, it is possible that a groove is formed over the entire width, and the circumferential end portion of the sheet is bent into the groove so that the peeling of the dielectric sheet is prevented over the entire width.

In the foregoing description, the transfer material supporting member has been in the form of a cylinder and is used for color copying machine. However, this is not limiting, and the present invention is applicable to another image forming apparatus, a monochromatic image forming apparatus or the like.

While the invention has been described with reference to the structures disclosed herein, it is not confined to the details set forth and this application is intended to cover such modifications or changes as may come within the purposes of the improvement or the scope of the following claims.

What is claimed is:

1. A transfer device for transferring a toner image onto a transfer material, comprising:
   - transfer material supporting means having a sheet-like material for supporting the transfer material and a supporting member for supporting the sheet-like material for movement along an endless path;
   - gripping means, mounted in an opening in said supporting member for releasably gripping an end of the transfer material; and
   - a sheet member mounted on said gripping means to cover at least a portion of said gripping means.

2. A device according to claim 1, wherein said sheet member covers an end portion of said gripping means which grips the transfer material.

3. A device according to claim 1, wherein said sheet member covers said gripping means.

4. A transfer device for transferring a toner image onto a transfer material, comprising:
   - a rotatable transfer material supporting drum for carrying the transfer material to a transfer station, said transfer material supporting drum including a cut-away portion and a longitudinal strip, wherein a sheet-like member is stretched over the cut-away portion;
   - a gripper mounted in the strip to releasably grip an end of the transfer material; and
   - a sheet member mounted on said gripper means to cover at least a part of said gripper means.

5. A device according to claim 4, wherein said gripping means is disposed in an opening in said strip.

6. A device according to claim 5, wherein the sheet member covers an end portion of the gripper means which grips the transfer material.

7. A device according to claim 5, wherein said sheet member covers said gripper means.

8. A device according to claim 4, further comprising cleaning means for cleaning a periphery of said transfer material supporting drum.

9. A transfer device for transferring a toner image onto a transfer material, comprising:
   - a transfer material carrying means including a sheet-like member for supporting the transfer material, supporting means for supporting said sheet-like member for movement along an endless path for carrying the transfer material to a transfer position, a releasable gripper means mounted on said sheet-like member supporting means, for releasably gripping an end of the transfer material, and a sheet member for covering at least a part of said gripper means without obstructing releasing and gripping action of said gripper means; and cleaning means contactable with said carrying means to clean a periphery of said carrying means.

10. A transfer device for transferring a toner image onto a transfer material, comprising:

a transfer drum including a transfer material supporting drum including a cut-away portion and a longitudinal strip, the cut-away portion being covered with a sheet-like member for supporting the transfer material, and wherein an end portion of the sheet-like material is bent toward inside of the transfer material supporting drum, and further including a releasable gripper means disposed in said supporting drum for releasably gripping an end of the transfer material; and cleaning means contactable with said transfer drum to clean the same.

11. A transfer device for transferring a toner image onto a transfer material, comprising:

transfer material supporting means for supporting the transfer material to carry it to a transfer station along an endless path;

gripping means, mounted in said transfer material supporting means for releasably gripping an end of the transfer material; and a sheet member projected from said gripping means.

12. A device according to claim 11, wherein said transfer material supporting means has a sheet-like material for supporting the transfer material and a supporting member for supporting the sheet-like material.

13. A device according to claim 12, wherein said gripping means is mounted in an opening in said supporting member.

14. A device according to claim 13, wherein said sheet member is mounted on said gripping means.

15. A device according to claim 11, wherein said sheet member is projected out of an end of said gripping means.

16. A device according to claim 1, 4, 9 or 11 wherein said sheet member covers at least a part of said sheet-like material.

17. A device according to claim 1, 4, 9 or 11, wherein said sheet member is of dielection film.

18. A device according to claim 1, 4, 9, 10 or 11 wherein said gripping means includes a plural gripper element juxtaposed with each other.

19. A transfer device for transferring a toner image onto a transfer material, comprising:

transfer material supporting means;

said supporting means having a sheet-like material for supporting the transfer material and a supporting member for supporting the sheet-like material for movement along an endless path, and wherein an end portion of the sheet-like material is bent toward inside of the supporting member.

20. A device according to claim 19, further comprising cleaning means contactable to said transfer material supporting means to clean the same.

21. A device according to claim 19, wherein said supporting member is in the form of a cylinder having end rings and a strip connecting the rings, said supporting member being provided with an opening in which said sheet member is stretched with its end bent toward inside of said supporting member in said strip.

22. A device according to claim 1, 4, 9, 10, 11 or 19 wherein plural toner images are superposed on the transfer material.

23. A device according to claim 22, wherein said toner image includes a chromatic color toner image.

* * * * *

UNITED STATES PATENT AND TRADEMARK OFFICE

CERTIFICATE OF CORRECTION

PATENT NO. : 4,875,069

DATED : October 17, 1989

INVENTOR(S) : YUSAKU TAKADA, ET AL.

It is certified that error appears in the above-identified patent and that said Letters Patent is hereby corrected as shown below:

COLUMN 3, line 34, "on" should be deleted.

COLUMN 4, line 2, "in" should read --is--;

line 22, "135" should read --133--.

COLUMN 5, line 48, "3" should read --7--;

line 62, "of" should read --of the--.

COLUMN 6, line 1, "all" should read --at all--;

line 3, "In" should read --In the--;

line 11, "been" should read --been described as--;

lines 51-52, "gripping" should read --gripper--.

UNITED STATES PATENT AND TRADEMARK OFFICE

CERTIFICATE OF CORRECTION

PATENT NO. : 4,875,069 Sheet 2 of 2

DATED : October 17, 1989

INVENTOR(S) : YUSAKU TAKADA, ET AL.

It is certified that error appears in the above-identified patent and that said Letters Patent is hereby corrected as shown below:

COLUMN 8, line 10, "dielection" should read --dielectric--;

line 12, "a" should be deleted;

line 13, "element" should read --elements--.

Signed and Sealed this

Twenty-eighth Day of August, 1990

*Attest:*

HARRY F. MANBECK, JR.

*Attesting Officer*

*Commissioner of Patents and Trademarks*